US006938566B2

(12) United States Patent
Hooks et al.

(10) Patent No.: US 6,938,566 B2
(45) Date of Patent: Sep. 6, 2005

(54) GARMENT ADAPTED FOR LABEL ATTACHMENT

(75) Inventors: William Robert Hooks, Winston-Salem, NC (US); Stephen Ray Castelloe, Asheboro, NC (US)

(73) Assignee: Sara Lee Corporation, Winston-Salem, NC (US)

( * ) Notice: Subject to any disclaimer, the term of this patent is extended or adjusted under 35 U.S.C. 154(b) by 0 days.

(21) Appl. No.: 10/743,371

(22) Filed: Dec. 22, 2003

(65) Prior Publication Data

US 2004/0133961 A1 Jul. 15, 2004

Related U.S. Application Data

(63) Continuation of application No. 09/972,013, filed on Oct. 5, 2001, now Pat. No. 6,687,918.

(51) Int. Cl.[7] ..... D05B 1/18; A41B 3/00

(52) U.S. Cl. ..... 112/475.09; 2/129

(58) Field of Search ..... 112/475.09, 475.06, 112/104, 113, 115, 470.33; 2/275, 69, 129, 139, 113, 116, 244; 40/642.02, 662; 235/462.01

(56) References Cited

U.S. PATENT DOCUMENTS

| | | | | |
|---|---|---|---|---|
| 1,112,805 A | | 10/1914 | Kaufman | 2/113 |
| 1,407,342 A | | 2/1922 | Vigneault | 2/131 |
| 1,438,850 A | | 12/1922 | Moeller | 132/312 |
| 1,481,371 A | | 1/1924 | Hughes, Jr. | 2/274 |
| 1,563,274 A | | 11/1925 | Furman | 2/129 |
| 1,568,595 A | * | 1/1926 | Freeman | 40/674 |
| 1,691,856 A | | 11/1928 | Robbins | 2/116 |
| 1,692,200 A | | 11/1928 | Capuano | 2/249 |
| 1,716,042 A | | 6/1929 | Goldberg | 2/116 |
| 1,742,816 A | | 1/1930 | Kennedy et al. | 2/129 |
| 1,798,056 A | | 3/1931 | Bean | 2/115 |
| 1,990,278 A | | 2/1935 | Friedmann | 2/115 |
| 2,134,425 A | | 10/1938 | West | 2/125 |
| 2,471,543 A | | 5/1949 | Riggs | 2/128 |
| 2,601,046 A | | 6/1952 | McDonald | 2/90 |
| 2,728,080 A | | 12/1955 | Beard | 2/113 |
| 2,750,595 A | | 6/1956 | Hollinger | 2/113 |

(Continued)

*Primary Examiner*—Ismael Izaguirre
(74) *Attorney, Agent, or Firm*—Womble Carlyle Sandridge & Rice, PLLC

(57) ABSTRACT

A garment adapted for attachment of a label subsequent to the substantially complete manufacture of the garment, where the garment comprises a joining seam between two garment components joined together to form a collar portion of the garment; and a strip which covers a portion of the joining seam, wherein a length of the strip is not attached on at least one side, thereby exposing the joining seam in order to facilitate the attachment of the label.

7 Claims, 2 Drawing Sheets

U.S. PATENT DOCUMENTS

| | | | | | |
|---|---|---|---|---|---|
| 2,752,703 | A | * | 7/1956 | Halperin | 40/662 |
| 2,790,179 | A | | 4/1957 | Piacenze | 2/116 |
| 2,935,749 | A | | 5/1960 | Blue | 2/116 |
| 3,281,863 | A | | 11/1966 | Beard et al. | 2/113 |
| 3,296,627 | A | | 1/1967 | Beard et al. | 2/113 |
| 3,873,999 | A | | 4/1975 | Artzt | 2/113 |
| 4,475,252 | A | | 10/1984 | Peyser et al. | 2/125 |
| 4,510,626 | A | | 4/1985 | Bowditch | 2/115 |
| 4,576,668 | A | | 3/1986 | Farrelly et al. | |
| 4,889,272 | A | | 12/1989 | Kunreuther | |
| 5,005,218 | A | | 4/1991 | Ganz | 2/69 |
| 5,005,219 | A | | 4/1991 | Diaz | 2/244 |
| 5,070,542 | A | * | 12/1991 | LaVelle et al. | 2/129 |
| 5,241,163 | A | * | 8/1993 | Vachtsevanos et al. | 235/449 |
| 5,293,648 | A | | 3/1994 | Finley | 2/243.1 |
| 5,315,946 | A | * | 5/1994 | Howell et al. | 112/113 |
| 5,371,904 | A | | 12/1994 | McEwen | 2/129 |
| 5,390,614 | A | | 2/1995 | Adamski et al. | 112/470.02 |
| 5,423,139 | A | * | 6/1995 | Feldman | 40/673 |
| 5,465,426 | A | | 11/1995 | Beaton | 2/195.1 |
| 5,548,847 | A | | 8/1996 | Spicijaric | 2/209.13 |
| 5,647,061 | A | | 7/1997 | Marcus | 2/11 |
| 5,651,677 | A | * | 7/1997 | Hildebrandt | 434/99 |
| 5,658,647 | A | * | 8/1997 | Magill et al. | 428/195.1 |
| 5,669,078 | A | | 9/1997 | Scremin et al. | 2/247 |
| 5,826,277 | A | | 10/1998 | McConville | 2/171 |
| 5,974,997 | A | | 11/1999 | Amburgey | 112/475.01 |
| 6,167,380 | A | | 12/2000 | Kennedy et al. | |
| 6,212,686 | B1 | | 4/2001 | Krause et al. | 2/129 |
| D444,291 | S | | 7/2001 | Poradzisz | D2/844 |
| 6,253,379 | B1 | | 7/2001 | Collier | 2/108 |
| 6,477,713 | B2 | | 11/2002 | Krause et al. | 2/129 |

* cited by examiner

GARMENT ADAPTED FOR LABEL ATTACHMENT

RELATED APPLICATIONS

This is a Continuation Application of U.S. application Ser. No. 09/972,013, filed Oct. 5, 2001, now U.S. Pat. No. 6,687,918.

FIELD OF THE INVENTION

The present invention relates generally to a garment adapted for the attachment of a label in the collar area after manufacture of the garment is substantially complete. The invention also related to a process for producing such a garment, as well as methods for manufacturing, marketing, and selling the garment of the invention.

BACKGROUND

Most garments are produced with a label that is attached to the garment at some attachment point, often a seam, by stitching which may be the same stitching used to create the seam. Shirts often have the label located at a back, inside portion of the collar. The attachment point of the label may be covered with a strip of material to flatten and smooth the label attachment point, possibly including a garment seam. To subsequently attach a label and/or remove an existing label, the cover strip must be detached along at least one edge to expose the label attachment area, a label must be inserted and secured by re-attaching the cover strip. This label attachment configuration is characteristic of many garments on the market today. Further, manufacturing requirements of some garments may more or less dictate the location and type of label attachment.

Garments such as t-shirts are produced having a body portion that is a knit tube. This creates a garment lacking side seams, for example, extending downward from the arm holes on either side. Because of this type of construction, all labels, including those required by government regulations, typically are attached at a collar seam of one type or another. Such labels usually are seen attached at the back of the collar attachment seam. This seam is created when a piece of material, known in the art as a "collarette," is folded and sewn around the garment neck to form a collar. During this sewing process, a label or labels may be attached, including the manufacturer's identifier and/or production information. In addition to t-shirts, other garments also often have labels attached in the back area of a collar portion regardless of the availability of other possible attachment points. This label attachment area may be chosen for a number of reasons, including its visibility to a potential purchaser when displayed for retail sale.

Several methods have been used to flatten and/or cover the seam that connects the collarette to the garment (the "joining seam"). One method involves the use of a strip of material known as a display. The display is sewn on the inside of the collar to cover the joining seam. One edge of the display strip is sewn into the joining seam as the collarette is attached. The display is then folded over the joining seam and attached to the garment body with an additional stitching. The display is used to cover the portion of the exposed joining seam that would be partially visible after the garment is packaged for sale, i.e. at the back of the neck.

Another method of covering the joining seam involves the use of a so-called "shoulder-to-shoulder" tape. In garments incorporating this structure, the "tape" or strip of material runs from the top of each arm hole, across the back, inside portion of the collar, and is attached using separate stitching above and below the joining seam between the collarette and the garment body.

Labels for such garments typically are attached by being sewn into the joining seam. When display strips or shoulder-to-shoulder tape are employed to cover a joining seam, the label attachment point is covered and made inaccessible by at least one additional stitching and layer of material.

Although the foregoing has addressed the labeling of shirts, especially t-shirts in a collar area, it will be recognized that it may be desirable to cover an attachment point of a label regardless of the location of the label. Otherwise, the end of the label, although stitched down or attached in some manner, may be aesthetically undesirable or actually present a point of discomfort to the wearer to the garment.

A significant market exists for garments that are subsequently labeled according to the demands of a purchaser from the garment manufacturer. Unlike garments produced by manufacturers as "private label" products, which typically have the final label inserted on behalf of a client by the manufacturer, some purchasers may require that the label be inserted at some point subsequent to manufacture of the garment (custon labeling). Also, it may be desirable for manufacturers to maintain a ready inventory of a garment adapted for attachment of a label subsequent to the substantially complete manufacture of the garment.

Currently, the labeling of garments after manufacturing often involves the cutting of stitching associated with a covering of the joining seam, insertion of a label (and perhaps the removal of an existing label), and re-attachment of the covering (either a display or shoulder-to-shoulder tape). This is, at least, a three step operation requiring significant time and expense to accomplish subsequent labeling of the pre-manufactured garment. Also, such labels may be attached by simply sewing the label on over the existing garment collar structure. This method may be aesthetically unacceptable or may produce a point of irritation for the wearer of the garment. Accordingly, a need exists for a garment that is produced to facilitate improved labeling, subsequent to the substantial completion of manufacture of a garment.

SUMMARY

The present invention provides a garment that is adapted for the efficient attachment of a label, subsequent to the substantial completion of the manufacture of the garment. The invention includes a process for producing such a garment, as well as a method for inventory, marketing, and sales of a garment adapted for subsequent labeling.

The processes, and various embodiments thereof, are described in more detail below. Although the present invention has been described with reference to certain embodiments, other embodiments may achieve similar results and advantages. Variations and modifications of the present invention will be apparent to one skilled in the art and the disclosure herein is intended to cover all such modifications and equivalents.

DETAILED DESCRIPTION

Figure 1:
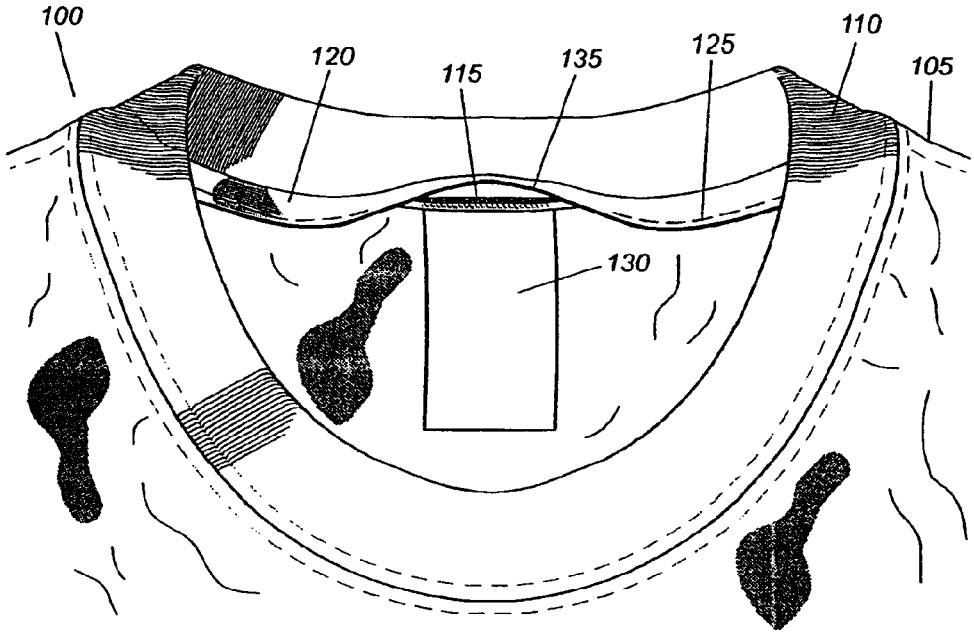
FIG. 1 shows an embodiment of the present invention in partial view of a t-shirt having a joining seam covered by a display.

In one aspect, the invention relates to a garment adapted for attachment of a label subsequent to the substantially complete manufacture of the garment. The garment comprises a joining seam between two garment components joined together to form a portion of the garment; and a strip that covers a portion of the joining seam. A length of the strip is detached on at least one edge portion so as to facilitate the attachment of the label. The length of the strip that is not attached on at least one edge portion may be located on an inside, back portion of a collar portion of the garment. The length of the strip that is not attached on one edge portion may be slightly longer than a width of a label to be attached, thereby allowing insertion and attachment of the label, for example by inserting the label and stitching the unattached edge to the garment through the label. A product information label may be provided and may be attached to the joining seam in an area corresponding to the location of the detached length of the strip.

In another aspect, the strip used to cover the joining seam is a display strip attached to the joining seam on a first edge portion and to the garment body over a portion of a second edge portion, thereby covering a portion of the joining seam. The first edge portion of the display strip may be attached to the joining seam by being sewn into the joining seam along with the two garment components. A lock stitch may be used to attach the strip edge portion adjacent to the unattached length. A method of attaching a display and label to a garment body is shown in U.S. Pat. No. 5,390,614, the disclosure of which is fully incorporated herein by reference.

In another aspect, the components forming the collar portion may include a collarette and a garment body that comprises a continuous knit tube. When the collarette is attached to the garment body, the two form a continuous collar. The garment may be a t-shirt.

Although the invention may comprise embodiments wherein the garment body is a tubular knit design, such as t-shirts, the invention is not limited to such garments. It will be recognized that the invention provides a garment adapted for the attachment of a label in any garment having a covering strip as a point of attachment for a label. Such garments include, but are not limited to, sports shirts such as golf shirts. The covering strip may cover a joining seam in the collar area, or be located at any other label attachment area of the garment.

In certain circumstances, it may be advantageous to produce a garment according to the invention wherein a cover stitch is associated with garment seams extending from a top of an arm hole to the collar attachment. This provides re-enforcement for these seams. In addition to re-enforcement, the cover stitch provides the exterior appearance associated with the use of shoulder-to-shoulder tape when such tape is not actually used, as when a display strip is used to cover the joining seam in the collar portion.

Although the invention may utilize a display strip as noted above, the invention also includes embodiments that use shoulder-to-shoulder tape as a covering for the joining seam in a collar portion of a garment. Accordingly, in another aspect, the invention includes a garment adapted for attachment of a label subsequent to the substantially complete manufacture of the garment, the garment comprising a joining seam between two garment components joined together to form a collar portion of the garment, and a shoulder-to-shoulder tape that covers a portion of the joining seam and that is attached along a first edge portion to one of the two garment components and along a second edge portion the other garment component. A length of at least one edge portion is detached so as to facilitate the attachment of the label. The garment component attached to the first edge portion of the tape may be a collarette, and the garment component attached to the second edge portion of the tape may be a garment body. Both edge portions of the tape may comprise a length that is unattached. In one embodiment, a length of the second edge portion (attached to the garment body) is detached in a label attachment area.

The invention also relates to a process for producing a garment adapted for attachment of a label subsequent to the substantially complete manufacture of the garment. The process comprises attaching a collarette to a garment body to form a joining seam; attaching a display strip to the collarette and the garment body by including a first edge portion of the display strip in a stitching forming the joining seam; folding the display strip over the joining seam; and attaching a second edge portion of the display strip to the garment body except over a length of the second edge portion corresponding to a label attachment area. Attachment of the second edge portion of the display strip on either side of the length corresponding to the label attachment area may comprise stitching the second edge portion to the garment body using a lock stitch. The process may also comprise attaching a product information label to the joining seam in label attachment area.

A process is also provided for producing a garment adapted for attachment of a label subsequent to the substantially complete manufacture of the garment using a shoulder-to-shoulder tape. The process comprises attaching a collarette to a garment body to form a joining seam; attaching a shoulder-to-shoulder tape to the collarette and the garment body by attaching a first edge portion of the shoulder-to-shoulder tape to the collarette along one side of the joining seam; and attaching a second edge portion of the shoulder-to-shoulder tape to the garment body, a length of at least one edge portion of the shoulder-to-shoulder tape corresponding to a label attachment area being detached. The at least one edge portion may be the second edge portion. Also, attaching the second edge portion of the shoulder-to-shoulder tape on either side of the length corresponding to the label attachment area may comprise stitching the second edge portion to the garment body using a lock stitch. The process may further comprise attaching a product information label in label attachment area.

The invention further includes a process for serving purchasers who require a garment adapted for attachment of a label. These purchasers may require limited quantities that do not support a traditional custom/private label manufacturing run, where the manufacturer produces the garment with the label according to the purchaser's requirements. Also, the purchaser may have an unplanned need for a garment which is substantially complete, but adapted for attachment of the purchaser's label. These needs are not met by current practices of custom/private label manufacturing.

Accordingly, yet another aspect the present invention includes a process for providing a garment article adapted for labeling subsequent to the substantially complete manufacture of the garment. The process comprises manufacturing the garment article; and maintaining the garment article in inventory. According to this aspect of the invention, a purchaser may be provided with a garment adapted for attachment of a custom label when that purchaser's quantity or time requirements would not support a typical custom label manufacturing run. Maintaining the garment in inventory allows the garment manufacturer to serve purchaser's having the needs discussed above, where no such option was previously available.

In one embodiment, the point of attachment is provided in the area of a collar seam of the garment. The collar seam may be a joining seam between a collarette and a garment body. In another embodiment, manufacturing the garment article may further comprise providing a pre-affixed label containing information concerning the garment.

In yet another aspect, the invention includes a process for providing an garment adapted for labeling subsequent to the substantially complete manufacture of the garment. This process comprises manufacturing the garment article by providing a point of attachment for a label, wherein subsequent attachment of the label by the purchaser requires no more than two additional steps; and maintaining the garment article in inventory. The two additional steps may comprise inserting the label and attaching a garment component adapted to cover the point of attachment. These steps may be accomplished by the purchaser or may be performed under their direction, possibly by a third party.

In another aspect, the invention provides a process for facilitating expedited filling of internal or external specialized label requirements. The process includes manufacturing a garment adapted for label insertion and attachment, and maintaining the garment in inventory for in-house use on demand for the production of specialized label garments. In one embodiment, the garment includes a strip covering a garment seam in a label attachment area, the strip having a length of at least one edge unattached to allow the insertion of a specialized label. The specialized label is subsequently secured by attachment of the at least one unattached edge over the inserted specialized label. A specialized label may be a private label or a label required for the production of a particular product of the manufacturer which was not determined at the time of substantially complete manufacture of the garment. The process according to the invention provides increased capacity to respond quickly to a need for a specialized label product.

In yet another aspect, the invention includes a process for facilitating expedited filling of customer private label orders. In this aspect of the invention, the garments of the invention which are adapted for label insertion and attachment are maintained inventory for in-house use on demand for the production of private label garments which are supplied to customers as completed products having the private label as directed by the customer. Maintenance of the garments of the invention in inventory allows rapid fulfillment of customer orders and provides flexibility in management of inventory required by private label operations (i.e. excess inventory could always be finished as the manufacturer's labeled garment if necessary to relieve an overage of a particular product produced for custom or private labeling).

The drawings illustrate particular embodiments of the invention. Referring now to FIG. 1, a garment 100 is shown wherein garment body 105 is attached to collarette 10 by joining seam 115. Joining seam 115 is covered by display strip 120, which is attached along one edge by being sewn together with collarette 110 and garment body 105 in joining seam 115. The other edge of display strip 120 is folded over joining seam 115 and attached over a portion of its length on either side of the label area by topstitching 125. A label 130, containing, for example, information required by government regulations, such as instructions for care of the garment, i.e. a "joker" label, may optionally be included in the garment of the invention. Unattached portion 135 allows for label attachment. A label can be simply inserted in a superimposed position relative to the joker label as shown, and then secured by stitching down the unattached portion 135 over the label.

Figure 2:
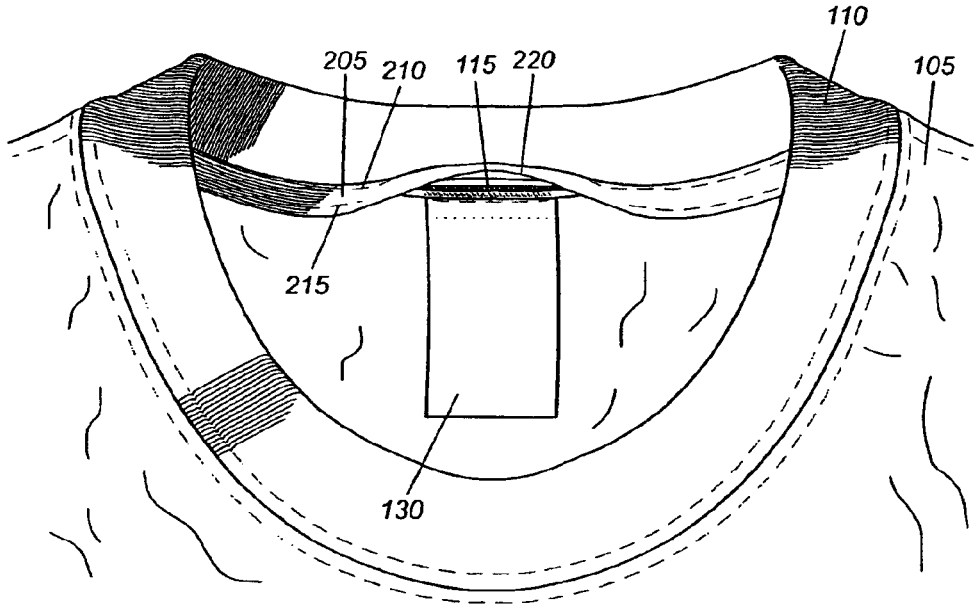
FIG. 2 shows an embodiment of the present invention in partial view of a t-shirt having a joining seam covered by shoulder-to-shoulder tape.

FIG. 2 shows an alternative embodiment of the invention wherein the strip covering the joining seam 115 is a shoulder-to-shoulder tape 205. The tape 205 is secured to the collarette 110 along one edge via stitching 210. The other edge of tape 205 is secured to garment body 105 via stitching 215, except for an unattached portion 220. Unattached portion 220 allows for label attachment as discussed above.

Figure 3:
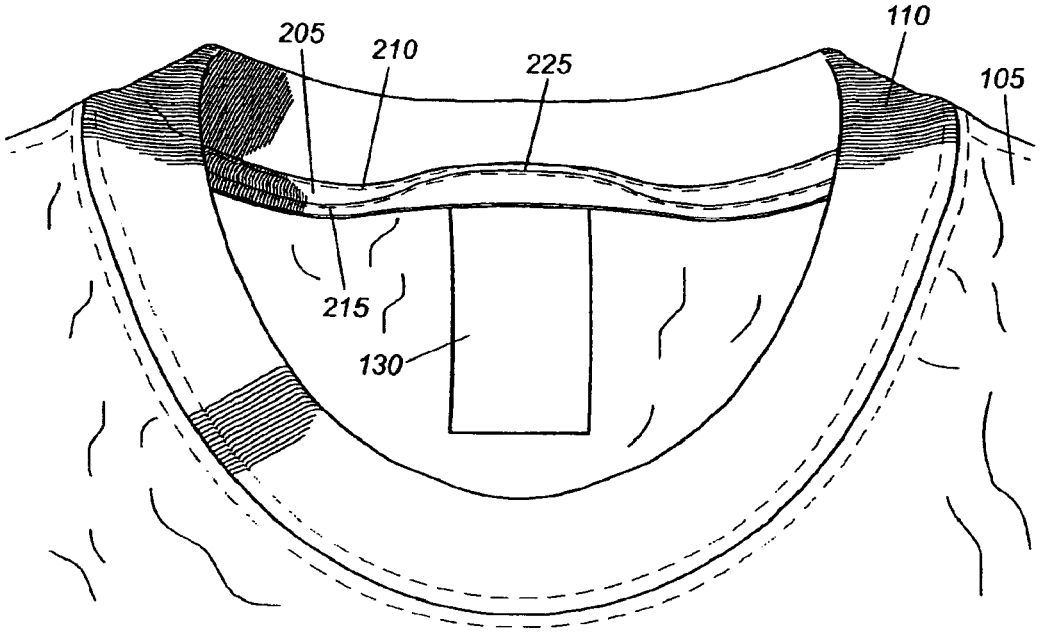
FIG. 3 shows a detailed view of one embodiment of the invention wherein an unattached side of a shoulder-to-shoulder tape (as in FIG. 2) is produced in a label attachment area by a deviation in the stitching which attaches one side of the display to the garment.

FIG. 3 shows yet another embodiment having shoulder-to-shoulder tape 205 as shown in FIG. 2, wherein an unattached portion 220 (not shown folded back, as in FIG. 2) is provided by deviation 225 in stitching 215. Accordingly, unattached portion 220 may be folded back or lifted to allow insertion of a label, which is secured by folding unattached portion 220 back into place and securing it with stitching over and through the inserted label.

While specific embodiments have been set forth as illustrated and described above, it is recognized that variations may be made with respect to disclosed embodiments. Therefore, while the invention has been disclosed in various forms only, it will be obvious to those skilled in the art that many additions, deletions and modifications can be made without departing from the spirit and scope of this invention, and no undue limits should be imposed except as set forth in the following claims.

What is claimed is:

1. A process for providing a garment adapted for labeling by a purchaser subsequent to the substantially complete manufacture of the garment, comprising:

manufacturing the garment comprising:

a joining seam between two garment components joined together to form a portion of the garment; and a strip having upper and lower edge portions and being attached along the edge portions to the garment components and covering a portion of the joining seam, a length of the strip being detached along at least one lower edge portion to expose the joining seam and facilitate the attachment of the label.

2. A process as in claim 1, wherein the point of attachment is provided in a collar seam of the garment.

3. A process as in claim 2, wherein the collar seam is a joining seam between a collarette and a garment body.

4. A process as in claim 1, wherein manufacturing the garment article further comprises providing a pre-affixed label containing information concerning the garment.

5. A process for providing an garment adapted for labeling by a purchaser subsequent to the substantially complete manufacture of the garment, comprising manufacturing the garment article by providing a point of attachment for a label, wherein subsequent attachment of the label by the purchaser requires no more than two additional steps;

wherein the two additional steps comprise inserting the label and attaching a garment component adapted to cover the point of attachment.

6. A process for facilitating expedited filling of internal or external requirements for specialized label garments, comprising:

manufacturing a garment adapted for label insertion and attachment, comprising:

a strip covering a garment seam in a label attachment area, the strip having a length of at least one edge unattached to allow the insertion of a specialized label; and a specialized label being subsequently secured by attachment of the at least one unattached edge over the inserted specialized label.

7. A process as in claim 6, wherein such garments are supplied to customers as completed products having a private label as directed by the customer.

* * * * *